US010482717B2

(12) United States Patent
Reetz

(10) Patent No.: US 10,482,717 B2
(45) Date of Patent: Nov. 19, 2019

(54) METHOD AND SYSTEM FOR GENERATING AN OPTIMIZED WAGERING STRATEGY

(71) Applicant: Thomas G Reetz, Atlanta, GA (US)

(72) Inventor: Thomas G Reetz, Atlanta, GA (US)

( * ) Notice: Subject to any disclaimer, the term of this patent is extended or adjusted under 35 U.S.C. 154(b) by 0 days.

(21) Appl. No.: 16/246,213

(22) Filed: Jan. 11, 2019

(65) Prior Publication Data

US 2019/0221080 A1 Jul. 18, 2019

Related U.S. Application Data

(60) Provisional application No. 62/616,743, filed on Jan. 12, 2018.

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/3223* (2013.01); *G07F 17/3244* (2013.01)

(58) Field of Classification Search
CPC ..... G07F 17/32
See application file for complete search history.

(56) References Cited

U.S. PATENT DOCUMENTS

2005/0116410 A1* 6/2005 Vlazny ..... G07F 17/32 273/139
2016/0189483 A1* 6/2016 Ballman ..... G06Q 50/34 463/28

* cited by examiner

*Primary Examiner* — Omkar A Deodhar

(57) ABSTRACT

A system for generating an optimized wagering strategy is disclosed. The system may include a communication device configured for receiving a wagering budget associated with the pari-mutuel event from a user device associated with a user account, receiving wagering data from at least one wagering data source, receiving prediction data from at least one handicapper device associated with at least one handicapper account, transmitting an optimized wagering strategy to the user device, and transmitting the optimized wagering strategy to an advance deposit wagering account associated with the user device. Further, the wagering data may include money wagered on each competitor of the plurality of competitors for each type of wager. Further, the user device may be configured for presenting the optimized wagering strategy. Further, the system may include a processing device configured for generating the optimized wagering strategy based on each of the wagering budget, wagering data and the prediction data.

14 Claims, 13 Drawing Sheets

METHOD AND SYSTEM FOR GENERATING AN OPTIMIZED WAGERING STRATEGY

The current application claims a priority to the U.S. Provisional Patent application Ser. No. 62/616,743 filed on Jan. 12, 2018.

FIELD OF THE INVENTION

The present disclosure generally relates to the field of sports wagering. More specifically, the present disclosure relates to methods and systems for generating an optimized wagering strategy.

BACKGROUND OF THE INVENTION

In today's world, many competitions are not only popular as a source of entertainment but also as a wagering opportunity. For example, there are numerous competitions, such as racing events like horseracing, which allow members of the public to wager in advance on the outcome.

Many, but not all, of the wagering on these competitions is managed under a system called pari-mutuel wagering. In pari-mutuel wagering, rather that prescribing odds/payouts in advance, the aggregate moneys wagered on the competition are calculated, a "tax" is then extracted to cover the various costs of operating the competition, and the balance is distributed to those with winning wagers. As a result, the payouts or odds cannot be determined in advance and only become known when all moneys wagered can be counted. Accordingly, odds/payouts can and do fluctuate widely as the moneys wagered accumulate, and the predicted payout on a wager made early in the wagering cycle may vary markedly from the actual payout calculated after all wagers are counted.

An individual's aggregate bets placed on the horses may turn out to be profitable for the better if his wagers correctly predict the actual outcomes of the event. But a successful wager in a horseracing event depends on many factors, including 1) the bettor's selection of the proper entries, 2) his choice of which of the myriad wagers presented should be accepted and which should be rejected, 3) the amount of each individual wager in relation to the aggregate of all the bettor's wagers on a specific competition and 4) the bettor's recognition that some wagers are mutually exclusive. For example, a wager that two entries in a racing completion will finish in the order a-b and another wager that the two entries finish in the order b-a cannot both be winning wagers.

Further, the anticipated return from a wager depends on the proportion of the total moneys wagered on losing bets vs. the moneys spent on successful wagers (which relationships determine the odds or ratio of moneys won vs. moneys wagered). Since wagers are placed over time, the odds change over time; in pari-mutuel wagering, as opposed to many more common games of chance (e.g. roulette) the payoffs are not determined until all the wagers have been accumulated and the payout computed. Additionally, each type of wager, such as a "Win" bet may carry a different venue-imposed tax, as previously defined, making the prediction of a payout even more difficult. Further, different venues may impose a different tax.

Further, in existing systems, the bettor often relies on speculative odds, such as those predicted by "experts" who attempt to forecast odds based upon their judgment of the ultimate actual distribution of the wagering moneys. Since these forecasts are made well in advance of the competition, they are subject to a host of possible events that may influence the actual wagering patterns that determine the actual payout. Weather conditions, the absence of one or more of the expected contestants, the current health/condition of the entrants, the condition of the racetrack surface and many other factors are relevant and make reliance on speculative payouts a risky proposition.

Further, the existing systems do not compute the optimized betting strategy based upon bettor's total budget. Accordingly, where multiple wagers may appear to be prudent, how to proportion the wagers within the bettor's budget is unaddressed.

Therefore, there is a need for improved methods and systems for generating an optimized wagering strategy that may overcome one or more of the abovementioned problems and/or limitations.

SUMMARY OF THE INVENTION

This summary is provided to introduce a selection of concepts in a simplified form that are further described below in the Detailed Description. This summary is not intended to identify all key features or essential features of the claimed subject matter. Nor is this summary intended to be used to limit the claimed subject matter's scope.

According to some embodiments, a system for generating an optimized wagering strategy is disclosed. The system may include a communication device configured for receiving a wagering budget associated with the pari-mutuel event from a user device associated with a user account. Further, the pari-mutuel event may be associated with a plurality of competitors. Further, the communication device may be configured for receiving wagering data from at least one wagering data source. Further, the wagering data may include money wagered on each competitor of the plurality of competitors for each type of wager. Further, the communication device may be configured for receiving prediction data from at least one handicapper device associated with at least one handicapper account. Further, the prediction data may include a plurality of top competitors. Further, the communication device may be configured for transmitting an optimized wagering strategy to the user device. Further, the user device may be configured for presenting the optimized wagering strategy. Further, the communication device may be configured for transmitting the optimized wagering strategy to an advance deposit wagering account associated with the user device. Further, the system may include a processing device configured for generating the optimized wagering strategy based on each of the wagering budget, wagering data and the prediction data. Further, the optimized wagering strategy may include a set of wagers. Further, a wager of the set of wagers may correspond to a type of wager, a wagering amount and a competitor of the plurality of top competitors associated with the wager.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
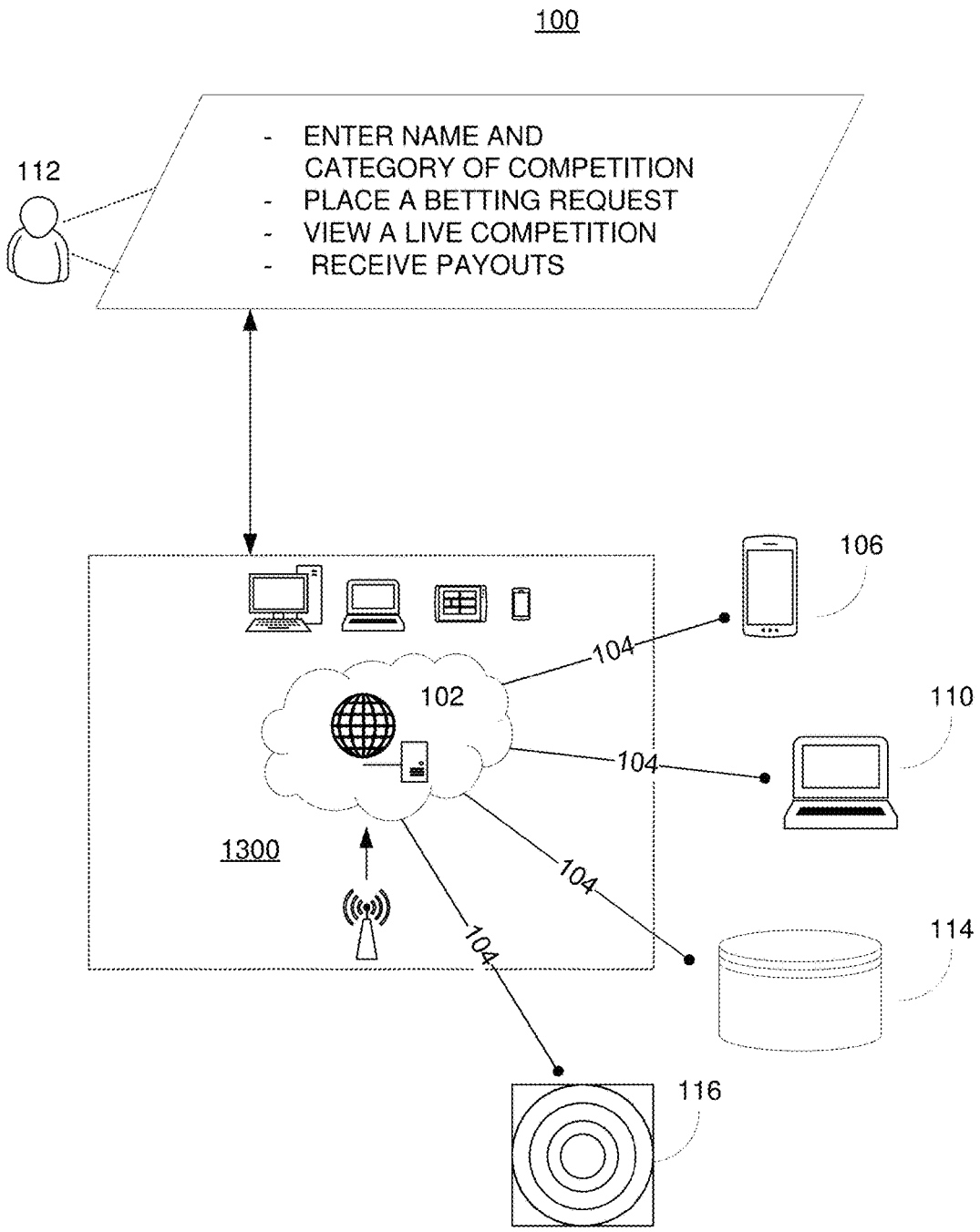
FIG. 1 is an illustration of a platform consistent with various embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of providing betting strategies, embodiments of the present disclosure are not limited to use only in this context.

FIG. 1 is an illustration of an online platform 100 consistent with various embodiments of the present disclosure. By way of non-limiting example, the online platform 100 for providing an optimized betting strategy in a competition may be hosted on a centralized server 102, such as, for example, a cloud computing service. The centralized server 102 may communicate with other network entities, such as, for example, a mobile device 106 (such as a smartphone, a laptop, a tablet computer etc.), other electronic devices 110 (such as desktop computers, server computers etc.), external databases 114 (e.g. databases associated with racing competition portals and/or wagering companies), and one or more sensors 116 (e.g. speed sensors, acceleration sensors, physiological sensors such as a heartbeat sensor, weather sensor) etc. over a communication network 104, such as, but not limited to, the Internet. Further, users of the online platform 100 may include relevant parties such as, but not limited to, public (e.g. viewers who want to watch live horseracing event), bettors (e.g. members of public who want to bet their money on a competitor, such as, a horse in the horseracing event), wagering company operators, administrators etc. Accordingly, in some instances, electronic devices operated by the one or more relevant parties may be in communication with the online platform 100. For example, the mobile device 106 may be operated by an individual, such as, for example, a bettor who wants to bet money on a horse competing in the horseracing event. Further, the individual may use the mobile device 106 to retrieve information associated with names of horses running in the horseracing event, venue of the horseracing event, estimated odds associated with the horses (e.g. odds associated with the horse on which the bettor bet the money), and estimated payouts associated with the horses (e.g. payout associated with an exacta bet betted by the bettor).

A user 112, such as the one or more relevant parties, may access platform 100 through a web-based software application or browser. The web-based software application may be embodied as, for example, but not be limited to, a website, a web application, a desktop application, and a mobile application compatible with a computing device 1300. In an instance, the online platform 100 may be termed as TrackAdvantage.

According to some embodiments, the online platform 100 may communicate, using a communication device, with the external databases and/or data sources 114, such as, databases associated with the wagering companies that hosts data associated with betting on racing events. In an instance, the databases associated with the wagering companies may store information, such as, but not limited to, upcoming racing events, venue information associated with upcoming racing events, live racing events and associated venues, payouts associated with each type of bet (e.g. Win Bets, Exacta Bets, Trifecta Bets) in a competition, and odds of winning associated with each competitor in the racing event etc. Furthermore, the database associated with the wagering companies may also include additional information like statistics related to performances of competitors (e.g. horses in a horseracing event) in previous competitions (e.g. horseracing competitions). Further, the online platform 100 may fetch the information stored by the databases associated with the competitions. Accordingly, based upon receiving the information, the online platform 100 may maintain an internal repository corresponding to the information pertaining to historical performances of competitors, upcoming competitions, live competitions, estimated payouts in a live and/or the upcoming competitions etc.

Figure 2:
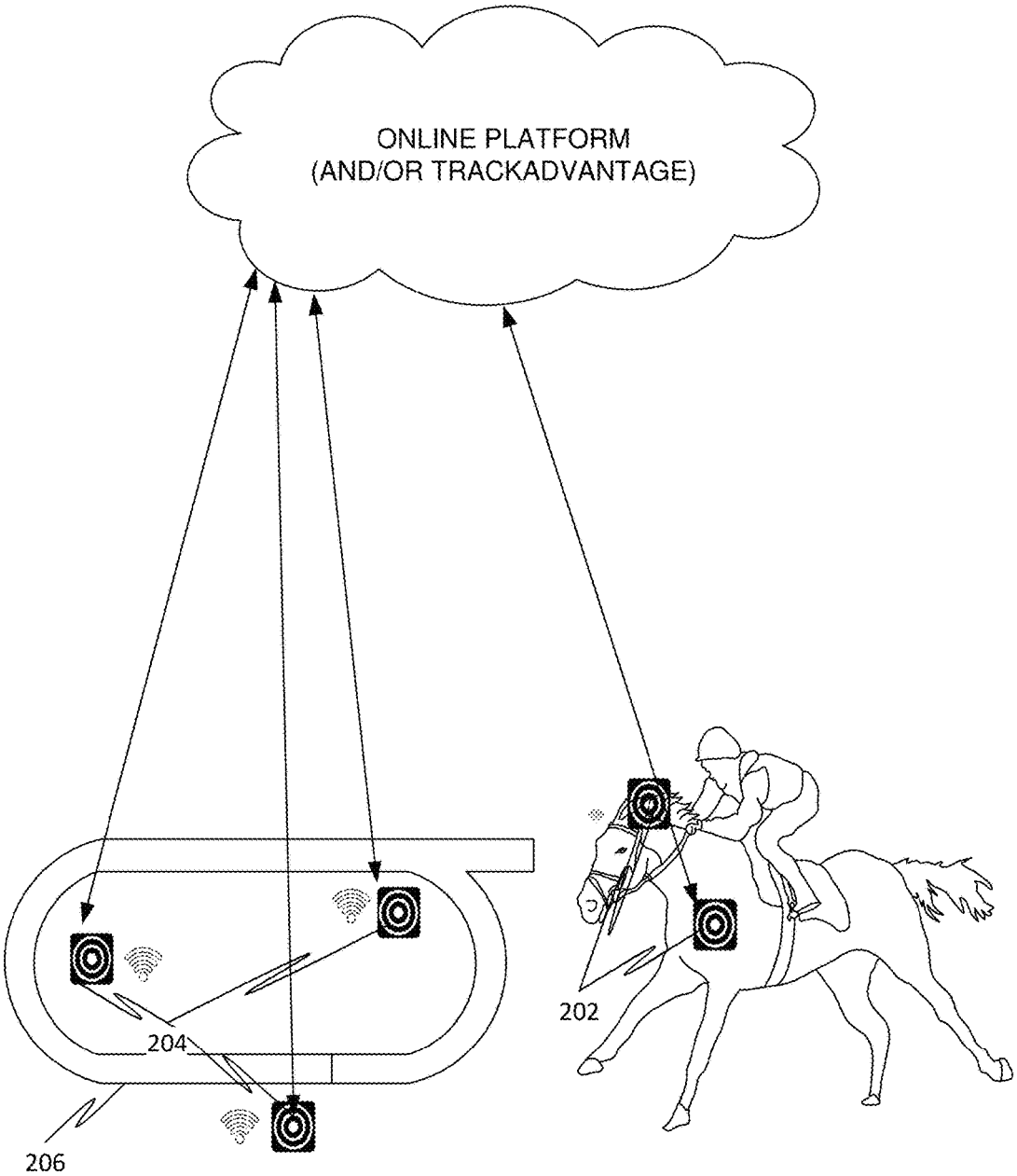
FIG. 2 illustrates communication of monitoring devices with a platform for providing an optimized betting strategy in a competition, in accordance with some embodiments.

Further, in some embodiments, the online platform 100 may be configured to communicate, using the communication device, with the one or more sensors 116, such as, for example, physiological sensors allied to competitors (e.g. horses who are running in the horseracing event) in the competition and/or weather sensors installed at the venue of the competition (e.g. on and/or near a racing track). Accordingly, the physiological sensors may detect health-related parameters, such as, for example, heartbeat, blood pressure, speed, number of steps, and distance travelled by the competitor taking part in the competition. FIG. 2 shows the online platform 100 interacting with physiological sensors 202 configured to measure activity and health-related parameters, such as, for example, heartbeat, blood pressure, speed, number of steps, and distance travelled by a horse. Further, weathers sensors, such as the weather sensors 204 may detect weather conditions associated with the venue of the competition. For example, the weather sensor may detect one or more of temperature, relative humidity, precipitation, air pressure, wind speed and wind direction. FIG. 2 shows the online platform 100 interacting with weather sensors 204 installed at the venue of the competition (e.g. on and/or near a racing track 206).

Accordingly, in some embodiments, the online platform 100 may factor in the sensor data in predicting the performance of competitors and accordingly generate optimized betting strategies in competitions.

Figure 3:
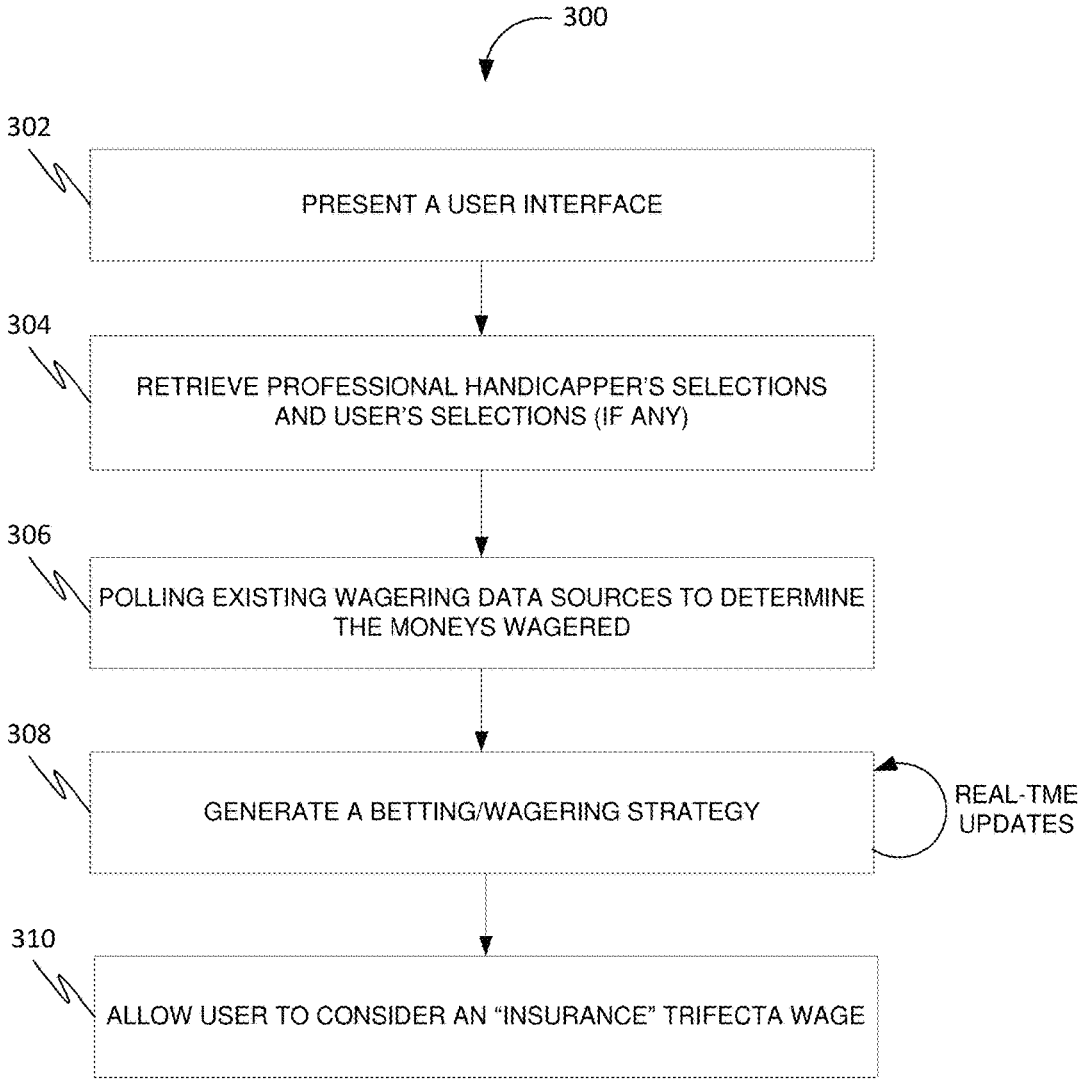
FIG. 3 illustrates a flowchart of a method for providing an optimized betting strategy in a competition, in accordance with some embodiments.

FIG. 3 illustrates a flowchart of a method 300 for providing an optimized betting strategy in a competition, in accordance with some embodiments. At 302, the method may include a step of presenting, using a processing device, a user interface associated with one or more competitions (e.g. a horse race, a baseball tournament, and so on) on a user device (e.g. the mobile device 106 operated by the bettor). The user interface may be provided by a software application, such as TrackAdvantage.

Further, at 304, the method 300 may include retrieving, using a communication device, a professional handicapper's selections. For example, the professional handicapper's selections, which may be available on a per-card, subscription or free basis, at tracks running in the United States may be retrieved. Further, the user may selections manually. Further, the method 300 may include examining the selections and checking the selections against the actual entry numbers at race time, allowing the identification and removal of entries that may have subsequently withdrawn (scratched). Additionally, the user may enter a prescribed dollar amount that may represents the maximum amount of all wagers placed on the event.

Once the selections are retrieved, or the user's own selections entered, at 306, the method 300 may include polling existing wagering data sources to determine the moneys wagered so far on each entry for each ty pe of wager. These amounts are available in real-time, and may be updated, at the User's command, as often as every forty-five seconds. For example, the method may include obtaining, using the communication device, the dollar balance of the Win and Place pari-mutuel pools for that race and the Exacta Will-Pays for each possible exacta pair, by querying via the Internet.

Thereafter, at 308, the method 300 may include generating, using the processing device, a betting/wagering strategy. For example, using proprietary algorithms, TrackAdvantage may compute the probability that any of 13 possible wagers will cash, the expected Return on Investment (ROI) for each, and devises a wagering strategy that provides a reasoned balance between the likelihood of success and the wagers' ROI, all within the budget specified by the user. Further, as the pools change, TrackAdvantage keeps pace, adjusting the wagering strategy, as required, on a real-time basis. The proprietary algorithms used by TrackAdvantage are explained in further detail below.

In further embodiments, starting with an aggregate wager budget set by the user and the top three entry selections, TrackAdvantage may seek out a rational way to divide the budget among Win, Place or Exacta bets. All of the possible 13 bets are considered: Win bets (3) for each of the top three selections, Place bets (3) for those three, each of the (6) Exacta pairs and (1) three entry Exacta Box. Further, TrackAdvantage may use some basic ground rules listed below:

1. Only 1 Win Bet will be proposed. Win Bets on multiple selections are not permitted.

2. Place bets can be made on a maximum of two entries.

3. All possible Exacta pair wagers are eligible, and a three-horse Exacta Box can be proposed as well.

4. ROI is the primary criterion used to evaluate a potential wager. The user must specify a minimum acceptable ROI for a winning outcome, as well as a minimum acceptable Overlay on Exacta Wagers.

5. The probability of cashing each of the 13 possible wagers is determined by considering the selected handicapper's historical performance coupled with advanced statistical techniques.

6. Exacta wagers are subject to an additional factor: the pari-mutuel promised Will-Pay compared to the "Overlay" value that TrackAdvantage calculates from the win odds of each paired entry.

7. The probability of cashing, the anticipated ROI and the Exacta overlay indicators are taken together, creating a proprietary blend used to identify qualifying wagers and then allocating the User's wager budget in proportion to the value of each.

As post time approaches, TrackAdvantage continually updates the strategy. Further, at 310, the method 300 may include allowing the user to consider an "Insurance" Trifecta wager, and then creating the Wagering Ticket, and forwarding the bet as per user's instructions.

In some embodiments, TrackAdvantage determines the anticipated dollar amounts a winning wager will return—known as the "Will-Pay". There are four different types of Will-Pays considered—Win Bets (paid when the entry selected wins the event), Place Bets (paid when the entry selected to finish second either wins or finishes second), Exacta Bets (when the user correctly identifies the entries finishing first and second in precise order), and Trifecta Bets (when the user correctly selects the entries that finish first, second and third in precise order).

A precise series of steps may be taken to insure the accuracy of the projected Will-Pays TrackAdvantage creates, each step composed of a different process. First, a process is employed to adjust the total moneys wagered on Win and Place bets for the amount of tax—or "Take-Out"—that the Manager of the betting pool invokes. Generally, the amount of tax invoked varies not only by the taxing jurisdiction where the wagering event occurs but with the type of wager—Win, Place, Exacta or Trifecta. Using the derived amount of moneys left to be distributed, TrackAdvantage employs a process to determine how much would be available per dollar wagered for distribution to the winner. Last, since all Win, Place, Exacta and Trifecta Will-Pays" are rounded down to the nearest nickel or dime, a process is employed to adjust each Will-Pay in that regard.

Further, since the amounts and proportion among entries and types of wagers is continually changing as the aggregate amount of moneys wagers grows, the Will-Pays as described above are constantly changing.

From the foregoing processes, the Win Will-Pay for each entry can be calculated, and the predicted Will-Pay evolves as the moneys wagered grow.

The methodology used to determine the Place Will-Pay is more complex since the Will-Pay depends on the identity of the winning entry as well as the entry finishing second (a wager on an entry to finish second is paid if the entry finishes first or second; since the same entry can't finish both first and second, two entries share the net moneys wagered on Place Bets. TrackAdvantage uses a proprietary methodology to estimate the likelihood of each other entry joining the entry finishing second, and, from this process, produces a projected Will-Pay for each Place wager. Again, the ability of TrackAdvantage to electronically gather and synthesize this information on a real-time basis dramatically increases the accuracy of the projected Will-Pays.

Managing the Exacta Will-Pays is a simpler process. Current Will-Pays for all Exactas are available on the internet from a variety of sources, and TrackAdvantage harvests this information and integrates it with Win and Place Will-Pays that TrackAdvantage has calculated via the processes described above.

The process of predicting Trifecta Will-Pays is complex. Predictions for Trifecta Will-Pays are not available from any known source. TrackAdvantage employs a proprietary methodology that includes the statistical likelihood that each selected entry will finish first, second or third. Then, using proven statistical techniques, TrackAdvantage's methodology determines the likelihood of occurrence of each possible order of finish of the top three selections. From this determination, a theoretical Trifecta Will-Pay can be determined which presupposes that the public's wagers conform precisely to the statistically derived orders of finish. Since it is unlikely that precise uniformity exists, TrackAdvantage then uses its own proprietary methodology to adjust theory to reality and generates a significantly more accurate estimate of Trifecta Will-Pays. The usefulness of the projected Trifecta Will-Pays is covered later in this description.

At this point, TrackAdvantage's process has produced an estimate of the Will-Pays, for each of the top three selections, for Win wagers (3), Place wagers (3), each of the (6) possible Exacta combinations and each of the (6) possible Trifecta Will-Pays, a total of 16 predicted Will-Pays.

TrackAdvantage monitors literally thousands of pieces of data, all of which are inter-related and which are updated approximately every 30-45 seconds. Each data update changes TrackAdvantage's estimates of the 18 predicted Will-Pays. These predicted Will-Pays form the basis of creating a betting strategy. The implementation of TrackAdvantage's methodology without the assistance of personal computer technology would not be possible. To that end, all of TrackAdvantage's processes and procedures have been designed to execute on such devices.

Using the predicted Will-Pays, TrackAdvantage determines the Expected Value of each by using a methodology that applies the probability of its occurrence, "Probability", to each of the predicted Will-Pays. The probability is derived from the selected Handicapper's historical performance, but the process is designed to accommodate a more or less likely probability if the user so specifies. Each Expected Value is then compared to TrackAdvantage's specified financial minimum return requirement, and the wager is deemed "Acceptable" or "Not Acceptable". Win and Place wagers earn Acceptable based on their Expected Value alone. But an additional, more stringent test is applied to Exacta Wagers. Specifically, TrackAdvantage, using proven statistical processes, utilizes a methodology which determines whether or not a given Exacta Pair has a promised Will-Pay higher or lower than a straight statistical computation would suggest. A lower Will-Pay, referred to in the trade as an "Underlay" will not be deemed Acceptable even if its Expected Value is satisfactory. To be acceptable, Exactas as a consequence must pass two tests—a satisfactory Expected Value and a Will-Pay higher than a simple statistical projection would suggest—defined as an "Overlay". Beyond simply exceeding the statistical projection, TrackAdvantage builds in a minimum percentage amount by which the Exacta Will-Pay must exceed the statistical projection, thus avoiding the potential of misclassifying an Overlay due to last minute shifts in the Exacta wagering pool. In some unique cases, the magnitude of the Exacta Overlay exceeds the Takeout the manager of the betting pool invokes. These Exacta pairs are automatically deemed Acceptable, regardless of their Expected Value.

From all wagers deemed Acceptable, TrackAdvantage uses a proprietary methodology to rank, weight and specify a suggested wager amount, insuring that the wagers in an aggregate match, and do not exceed, the User's Wagering Budget. Additionally, since each Manager of a betting pool specifies the minimum wager amount that will be accepted, TrackAdvantage insures that this minimum is honored.

The end result is a Betting Strategy: A set of wagers, specifying the type of wager, on which entry or entries and in what amount. A sample TrackAdvantage Wagering Ticket is produced, showing the Date, Track Name, Race Number and the list of wagers to be placed. A link is provided to transmit the wagering instructions to the Advance Deposit Wagering (ADW) on-line website the user has selected to place his bets.

Following TrackAdvantage's methodology, it is possible that the Wagering Strategy may fail to show a profit, despite the fact that the selected Handicapper has succeeded in predicting the top three finishers of the event. This is true because TrackAdvantage's methodology will reject some wagers because they offer an insufficient return when measured against the amount of risk the bet entails. For example, the handicapper may predict the order of finish as a-b-c, and the actual order of finish is b-c-a. TrackAdvantage may have suggested a Win wager on c, and an Exacta wager on b-a. Both wagers would fail, but the fact remains that the handicapper's selections were, by any measure short of perfection, very accurate. To mitigate against this unpleasant outcome, TrackAdvantage's methodology identifies which of the 6 possible n-n-n outcomes would fail to show the User a profit, projects the dollar Trifecta return on each, and calculates the necessary Trifecta wager(s) necessary to at least break even in any circumstance where the Handicapper's selections run a-b-c in any order.

A Trifecta Wagering Ticket, similar in form to a TrackAdvantage Wagering Ticket, and a link to the User's ADW is provided.

In an exemplary embodiment, TrackAdvantage follows following steps to generate a wagering strategy. For each of 13 possible wagers—(3) Win Bets, (3) Place Bets, (6) 2—entry Exactas and (1) 3 Entry Exacta Box—TrackAdvantage calculates the Return on Investment (ROI) percentage. The calculation is performed as described below.

For Win Bets, TrackAdvantage determines the $2 Will-Pay amount by inspecting the Win Pari-mutuel pool for each of the three picks, taking into account the Track Takeout percent and the effect of "breakage". In an example, the $2 Will-Pay is determined to be $7.60. Use the chosen Handicapper's Historical data to determine his/her Win Percent, i.e. the percentage that represents how often the Handicapper's top pick wins the race. Once that percentage is determined, apply it to the calculated $2 Will-Pay. Hence, if the Handicapper's Win Percent is 30%, the expected return is 30% times $7.60 (or $2.28). The ROI is $2.28 less the $2 Wager (or $0.28), which, when divided by the investment of $2 to yield an expected ROI of 14%.

Similarly, the expected ROI for Win Bets on the Handicapper's 2nd and 3rd choices can be determined by calculating the $2 Will-Pay, applying the Handicapper's historical winning percentage for his 2nd/3rd pick and computing each's ROI.

For Place Bets, TrackAdvantage calculates the ROI for Place Wagers (this is more complicated). TrackAdvantage begins by establishing five entries—the Handicapper's 1st Selection, his 2nd Selection and his 3rd selection, plus two Field Entries, called "A" and "B". The probabilities that each of the five entries will finish first, and the probability of each of the five entries finishing second (25 percentages in all, summing to 100%) are calculated by examining the historical record of the chosen handicapper and using those percentages, and the Harville methodology. Then, TrackAdvantage uses the Place pari-mutuel pool, and computes the place payout (adjusting for Track Takeout and breakage) for each possible combination (25 in all). These payouts are then matched up to the percentage probability of occurrence, and the weighted average Place Will-Pay is created. In the tests, a study of 442 Place Will-Pays showed a median error of just under 10%.

The Harville Methodology is a technique that determines the probability of an event "B" given that event "A" has occurred. To illustrate, assume there are 10 balls of 4 different colors in a bag. There are 4 blue balls, 3 red balls, 2 green balls and 1 white balls. The probability of blindly selecting a blue ball is 40%, red 30%, green 20% and white 10%. But once a blue ball is selected (and the remainder of the blues discarded) the chances of the red ball being next is now 50% (3/6) not 30%—and the probability of a blue selection followed by a red selection is 20% (40%*50%). This methodology is used by TrackAdvantage in establishing probabilities of Place and Exacta combinations.

For evaluating Two Entry Exactas, TrackAdvantage analyzes each Two Entry Exacta pair is analyzed three ways: ROI, Overlay/Underlay and Positive Expectation Wagers. These are explained in detail below.

ROI—Here, the probability of each (there are 6 pairs—using the Handicapper's 3 selections) Exacta pair's outcome is determined by using the Handicapper's success history and computed using the Harville methodology. A Tote board's posted Exacta Will-Pays are multiplied by the calculated probabilities to create an "Expected Value", from which is calculated an ROI for each pair.

For example, assume there are four entries in a race—a, b, c and d. The probability of an a-b finish in that order is determined to be 7%. If the Tote board says that the Will-Pay on a $2 Exacta is $30, the Expected Value is $2.10 (7%× $30), the ROI is $0.10 ($2.10–$2.00) and the ROI percentage is 5% ($0.10/$2.00).

Overlay/Underlay—Here we ignore the Handicapper's history and focus on the Pari-mutuel Win Pool. Using the Win Pool amounts, TrackAdvantage calculates each entry's probability of winning, and using the Harville methodology, the probability of every other entry finishing second. The probability of each pair finishing $1^{st}$ and $2^{nd}$ is used to establish the "Fair Return". For example, if the Win Odds on the "a" entry suggest a 20% chance of winning, and the Win Odds on "b" suggest an 8% chance of winning, the chances that they will finish a-b is 2%. (20%×(8%/(100%−20%))). Setting aside the Exacta Takeout, that says that a "Fair Return" on a $2 wager would be about $100−(2% of $100 is $2, less the $2 cost of the wager makes this a break-even proposition). An Overlay is then calculated as a percent of the net dollars returned in excess of the Fair Return amount. The higher the Overlay percent, the more attractive the wager becomes. Similarly, an Underlay returns less than a Fair Return and is avoided.

Positive Expectation Wagers—Occasionally the Overlay on an Exacta pair is so large as to exceed the Track's Exacta Takeout percentage. For example, if the Overlay Percentage is 40%, and the Track's Exacta Takeout Percentage is 25%, the bet is a Positive Expectation Wager, since the 40% over the Fair Return is greater than 33% (25%/(100%−25%)). TrackAdvantage will recommend this bet regardless of the Wager's Expected ROI.

Further, TrackAdvantage evaluates the 3 Entry Exacta Box in essentially the same way, but with some technical differences. Actually, a 3 Entry Exacta Box is simply a wager covering all six possible Exacta Pairs from the three entries. When TrackAdvantage evaluates each of the six possible Exacta pairs individually it insists that a minimum expected ROI and a minimum level of Overlay exists. In evaluating the aggregate 3 Entry Exacta Box, TrackAdvantage only insists that the simple average ROI across all six combinations exceeds the minimum expected ROI; that means the expected ROI on one or more of the pairs is less than the minimum, and may even have an expected ROI as a negative value. If this average expected ROI exceeds the specified minimum, and each of the six pairs is an Overlay, to whatever degree, the Exacta Box qualifies. Beyond this, if the average Exacta Overlay assuming each pair is an Overlay to some degree, exceeds the track's Exacta Takeout percent, the Exacta Box qualifies regardless of the aggregate or individual expected ROI. Speaking generally, TrackAdvantage is a little more tolerant of a lower than desired ROI on a 3 Entry Exacta Box than an individual Exacta pair, permitting the presence of one or more sub-par expected ROI's because a "six for six" count of overlays is too good to ignore. (And it doesn't occur very often.)

Culling the Wagers—Using ROI for the six possible Win and Place Wagers, of those that equal or exceed the Minimum ROI, the single highest Win selection is chosen. (There is no "clutching"—making win bets on multiple entries in the same event). If there is more than one qualifying Place Wager, up to two may be selected.

Of the six possible Two Entry Exactas, all those which equal or exceed the minimum expected ROI and are above the minimum Overlay requirement are selected.

For the 3 Entry Exacta Box, if the average ROI qualifies and all individual components equal or exceed the stipulated Overlay minimum, it is selected. In addition, both the Exacta Box and Exacta Pairs will qualify regardless of the expected ROI if the Overlay percentage exceeds the track's Exacta Takeout percent.

Accordingly, TrackAdvantage may generate a single wagering strategy. In this embodiment, the strategy can be characterized as "Moderate" as opposed to "Aggressive" or "Conservative". In some embodiments, the User may choose to assume a more Conservative posture, and TrackAdvantage will adjust the wagering strategy by emphasizing Likelihood of Cashing over ROI. An Aggressive approach emphasizes ROI over the Likelihood of Cashing.

Therefore, TrackAdvantage seeks out the wagers that pass the tests outlined above. Then it allocates the assigned Wagering Budget toward those bets, with extra weighting based on their Likelihood of Cashing. TrackAdvantage doesn't "shoot the moon" nor does it seek a steady diet of odds-on favorites.

Further, as post time approaches, TrackAdvantage continually updates the strategy, allowing the user to consider an "Insurance" Trifecta wager, and then creates the wagering ticket, and forwards the bet as the user dictates, for example, by using the mouse click.

The TrackAdvantage Strategy has been tested against some common other strategies, on good handicapping days and bad ones. It has been found that using the TrackAdvantage Wagering Strategy may bring about a 23 percentage point improvement in the User's bottom line performance, if the User follows the most popular and common wagering strategies. In making that comparison, both approaches used the same handicapper's selections, so that handicapping prowess was not a factor. Of course, there is absolutely no guarantee that TrackAdvantage will raise a particular user's game regardless of the time horizon.

Figure 4:
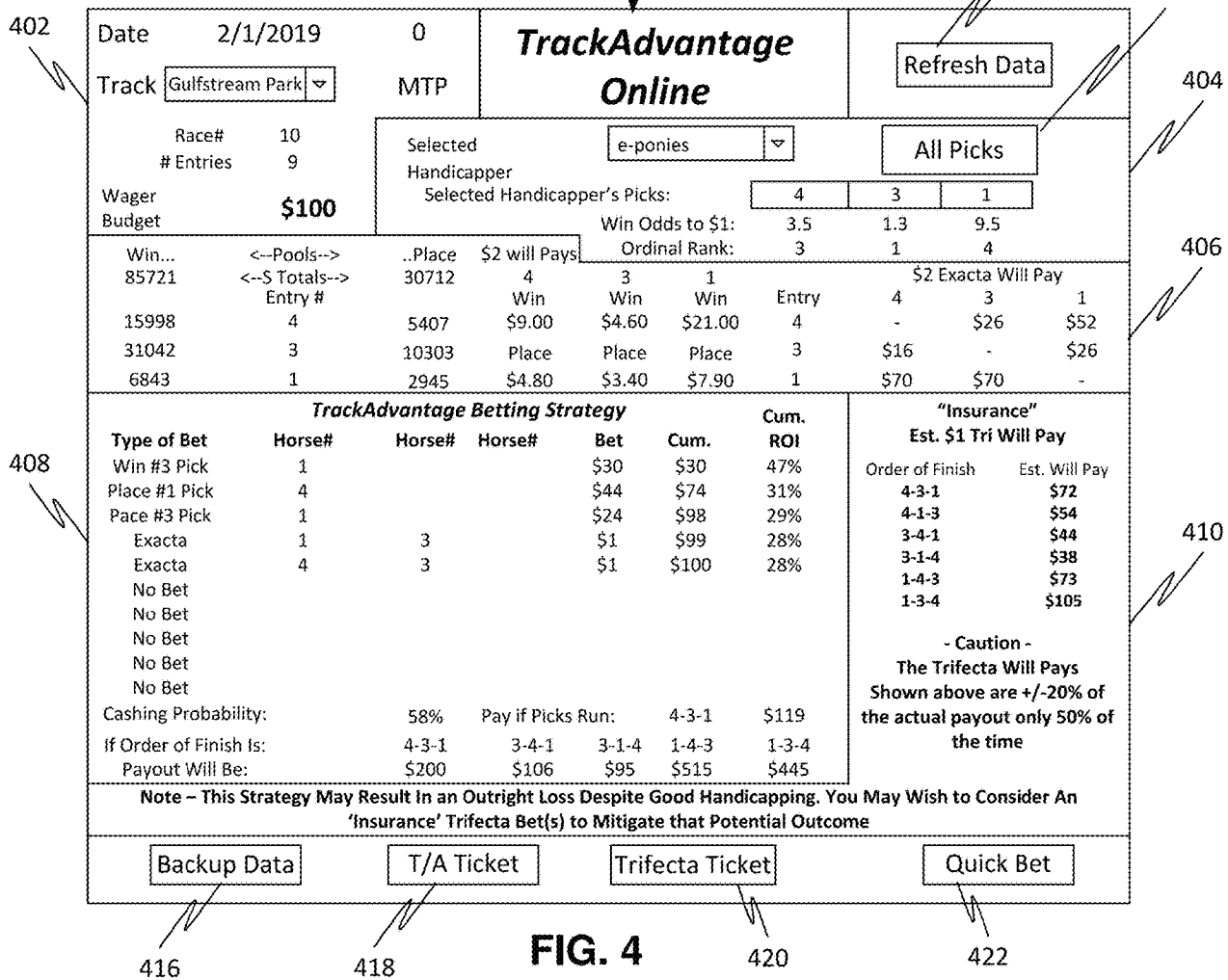
FIG. 4 illustrates a user interface of an application for providing an optimized betting strategy in a competition, in accordance with some embodiments.

FIG. 4 shows an exemplary user interface of TrackAdvantage in accordance with an exemplary embodiment. The user interface 400 of TrackAdvantage may include distinct but inter-related sections. The user interface 400 may include a track facts section 402, which may include information such as date, track, race number, entries, estimated remaining wagering time (MTP) and the User's wager budget. Further, the user interface 400 may include a handicapping section 404, which may include information such as professional picks, user's own picks, choices, current odds and ordinal rank. Further, the user interface 400 may include a tote board data section 406, which may include information such as pools, Win/Place Will-Pay and Exacta Will-Pay.

Further, the user interface 400 may include a betting strategy section 408, which may show information related to one or more generated betting strategies.

Further, the user interface 400 may include a Trifecta insurance section 410.

Further, the user interface 400 may include a plurality of buttons available on the user interface of TrackAdvantage. When a Refresh Data button 412 is activated, the entirety of the user interface 400 may be updated based on changes to the wagering pool (pari-mutuel) and/or Handicapper's or User's selections, and/or late withdrawal of an intended entry, and/or MTP (approximate time before the wagering pools close), which altogether or singly may cause revision to the wagering strategy.

When an All Picks button 414 is activated, all the Professional Handicapper's Picks may be disclosed, in order.

A Backup Data button 416 may permit the user to backup data shown in the user interface 400, and view the data to be backed-up in a back-up user interface 1100, and toggle back and forth between the user interface 400 and the back-up user interface 1100.

When a T/A Ticket button 418 is activated, a representation of an actual wagering ticket may be displayed, excluding any Trifecta wager, showing date, event, venue, all wagers by entry and wager type, and the aggregate amount thereof, suitable for transmission to the chosen ADW. In this embodiment, provision may be made for the user to override the T/A Strategy and substitute the wagers of his choice.

Figure 12:
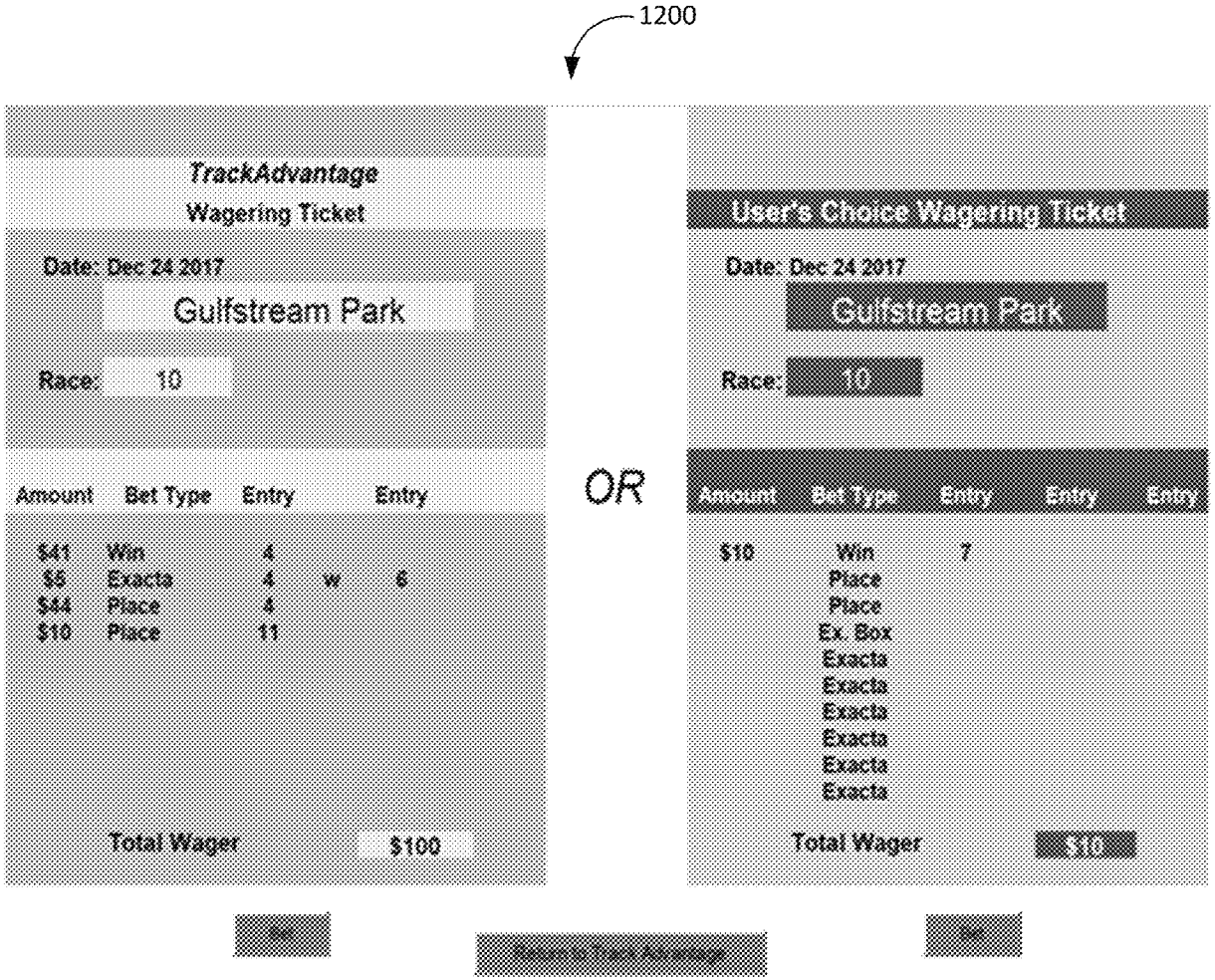
FIG. 12 shows an exemplary wagering ticket, in accordance with some embodiments.

When a Trifecta Ticket button 420 is activated, a representation of an actual Trifecta wagering ticket is displayed, such as a wagering ticket 1200 as shown in FIG. 12 showing the amount of the wager(s) and the entries selected, providing "insurance" against the failure of the T/A's wagering strategy to at least break even despite superior handicapping, suitable for transmission to the chosen ADW.

When a Quick Bet button 422 is activated, a condensed version of both T/A Ticket and Trifecta Ticket is displayed suitable for direct transmission to the ADW chosen by the User.

Figure 11:
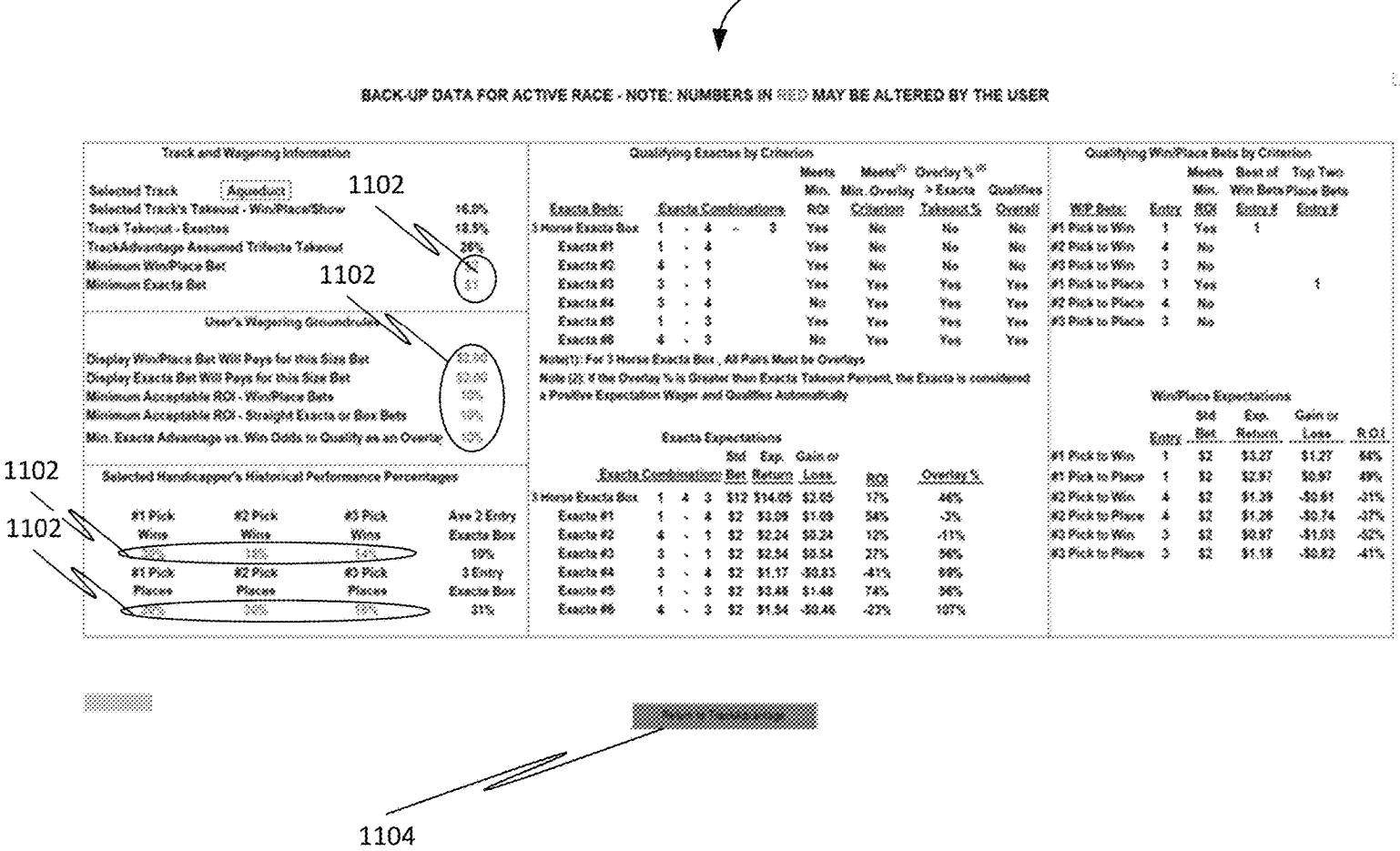
FIG. 11 shows a back-up user interface showing a repository of base assumptions, in accordance with some embodiments.

FIG. 11 shows the back-up user interface 1100 showing a repository for the user's base assumptions like Wager Amount. The back-up user interface 1100 may allow variables 1102 to be changed. Other data on the back-up user interface 1100 may provide detail as to the numbers that led to a wager's inclusion or exclusion from the wagering strategy. A graphic representation of the TrackAdvantage betting strategy betting ticket may be accessible by clicking the T/A Ticket button 418, as illustrated in FIG. 4. Further, the Trifecta Ticket is accessible by clicking the Trifecta Ticket button 420. The User has the ability to quickly accept the TrackAdvantage Wagering Strategy, including the purchase of an insurance Trifecta wager by simply clicking the Quick Bet button 416. The All Picks button 414 when clicked may display the Selected Handicapper's predicted order of finish for all the entries in the current race. The Refresh Data button 412 loads all updated pari-mutuel data, and recalculates all formulae, including the creation of a revised TrackAdvantage betting strategy.

Clicking on a Return to TrackAdvantage button 1104 may take the user back to the user interface 400.

Figure 5:
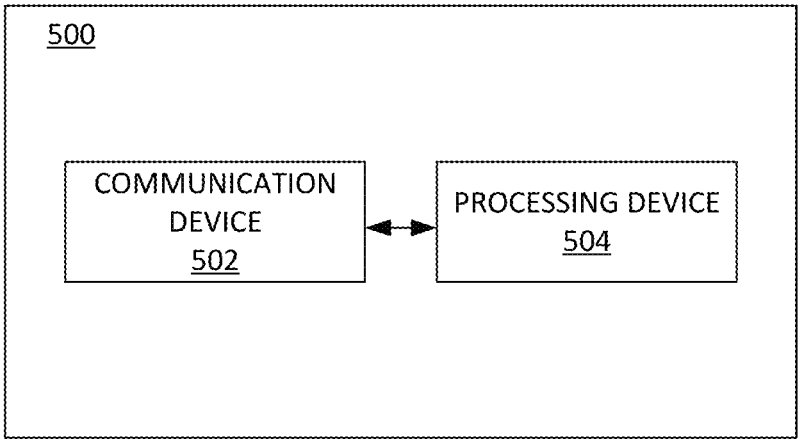
FIG. 5 shows a system for generating an optimized wagering strategy, in accordance with some embodiments.

FIG. 5 shows a system 500 for generating an optimized wagering strategy. The system 500 may include a communication device 502 configured for receiving a wagering budget associated with the pari-mutuel event from a user device associated with a user account. Further, the pari-mutuel event may be associated with a plurality of competitors. Further, the communication device 502 may be configured for receiving wagering data from at least one wagering data source. Further, the wagering data may include money wagered on each competitor of the plurality of competitors for each type of wager. Further, the communication device 502 may be configured for receiving prediction data from at least one handicapper device associated with at least one handicapper account. Further, the prediction data may include a plurality of top competitors. Further, the communication device 502 may be configured for transmitting an optimized wagering strategy to the user device. Further, the user device may be configured for presenting the optimized wagering strategy. Further, the communication device 502 may be configured for transmitting the optimized wagering strategy to an advance deposit wagering account associated with the user device. Further, the system 500 may include a processing device 504 configured for generating the optimized wagering strategy based on each of the wagering budget, wagering data and the prediction data. Further, the optimized wagering strategy may include a set of wagers. Further, a wager of the set of wagers may correspond to a type of wager, a wagering amount and a competitor of the plurality of top competitors associated with the wager.

In some embodiments, the communication device 502 may be further configured for receiving an indication of at least one withdrawn competitor. Further, the processing device 504 may be configured for determining the plurality of top competitors based on the indication of at least one withdrawn competitor.

In some embodiments, the communication device 502 may be further configured for receiving a minimum return requirement from the user device. Further, the generating of the optimized wagering strategy may be based on the minimum return requirement.

In some embodiments, the processing device 504 may be further configured for calculating a success likelihood of each wager corresponding to each of the plurality of top competitors. Further, the calculating may be performed based on historical performance data of one or more of the user account and the at least one handicapper account.

In some embodiments, the processing device 504 may be further configured for determining a plurality of will-pay amounts corresponding to the plurality of top competitors. Further, a will-pay amount corresponding to a top competitor may represent an anticipated monetary amount returned from a winning wager placed on the top competitor. Further, the optimized wagering strategy may include the plurality of will-pay amounts.

In some embodiments, the processing device 504 may be further configured for determining a plurality of expected values corresponding to the plurality of will-pay amounts. Further, the plurality of expected values may be based on historical performance data of one or more of the user account and the at least one handicapper account. Further, the processing device 504 may be configured comparing the plurality of expected values with a minimum return requirement received from the user device. Further, the processing device 504 may be configured for determining acceptability of the plurality of will-pay amounts based on the comparing.

In some embodiments, the processing device 504 may be further configured for determining, for a two-entry wager corresponding to two top competitors of the plurality of top competitors, an indication of whether a first will-pay amount corresponding to the two-entry wager may be greater than a second will-pay amount corresponding to individual wagers associated with each of the two top competitors. Further, the optimized wagering strategy may include the indication.

In some embodiments, the processing device 504 may be further configured for determining a plurality of qualifying wagering investments. Further, a qualifying wagering investment may correspond to a plurality of potential top competitors of the plurality of competitors. Further, the processing device 504 may be configured for generating a plurality of ranked qualifying wagering investments based on the plurality of qualifying wagering investments, the wagering budget and a minimum wager amount associated with the pari-mutuel event. Further, the optimized wagering strategy may be based on the plurality of ranked qualifying wagering investments.

Figure 6:
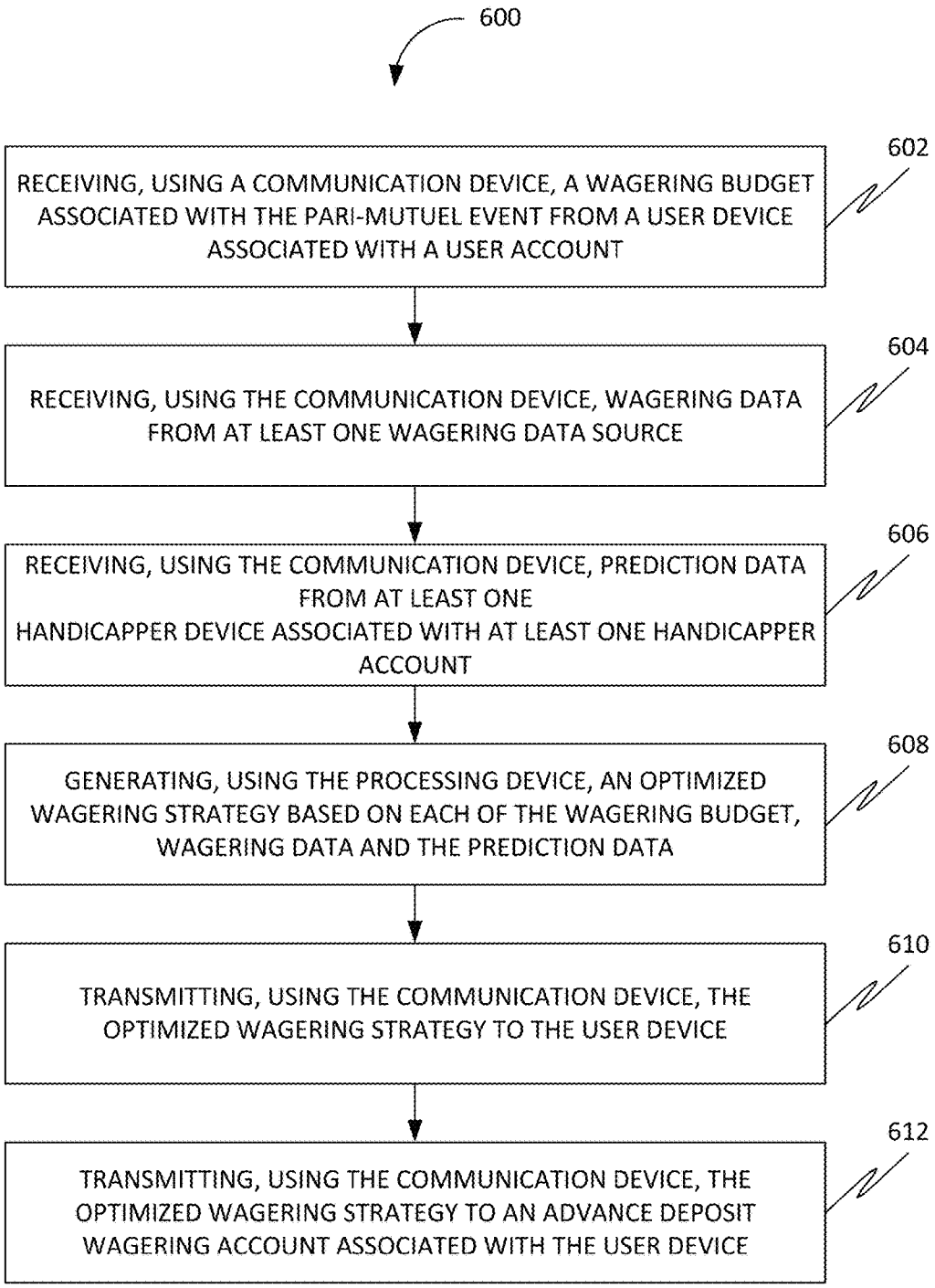
FIG. 6 shows a method of generating an optimized wagering strategy, in accordance with some embodiments.

FIG. 6 shows a method 600 of generating an optimized wagering strategy. At 602, method 600 may include receiving, using a communication device, such as the communication device 502, a wagering budget associated with the pari-mutuel event from a user device associated with a user account. Further, the pari-mutuel event may be associated with a plurality of competitors. In pari-mutuel wagering, rather than prescribing odds or payouts in advance, an aggregate amount of money wagered on the pari-mutuel event may be calculated, at least one of a tax, a fee and a commission may be then extracted to cover the various costs of operating the pari-mutuel event, and a balance may be distributed amongst winning wagers. As a result, the payouts or odds may not be determined in advance. Further, the user account may represent the user operating the user device. Further, the user account may include user data corresponding to the user, such as for example, user profile, historical data corresponding to the user's activity associated with the pari-mutuel wagering and so on.

Further, at 604, the method 600 may include receiving, using the communication device, wagering data from at least one wagering data source. Further, the wagering data may include money wagered on each competitor of the plurality of competitors for each type of wager.

Further, at 606, the method 600 may include receiving, using the communication device, prediction data from at least one handicapper device associated with at least one handicapper account. Further, the prediction data may include a plurality of top competitors.

Further, at 608, the method 600 may include generating, using a processing device, such as the processing device 504, an optimized wagering strategy based on each of the wagering budget, wagering data and the prediction data. Further, the optimized wagering strategy may include a set of wagers. Further, a wager of the set of wagers may correspond to a type of wager, a wagering amount and a competitor of the plurality of top competitors associated with the wager. Further, the type of wager may include at least one of a win bet, a place bet, an exacta bet, and a trifecta bet. Further, a win bet may comprise a wager in which a selected entry may win the pari-mutuel event. Further, a place bet may comprise a wager in which a selected entry may finish at a selected or better position. For instance, entry selected to finish second may either finish second, or win the either the pari-mutuel event. Further, an exacta bet may comprise a wager in which competitors finishing first and second the in the pari-mutuel event may be identified in a precise order. Further, a trifecta bet may comprise a wager in which competitors finishing first, second, and third in the pari-mutuel event may be identified in a precise order.

Further, the optimized wagering strategy may comprise a set of one or more wagers, specifying the type of wager, one or more competitors on which the one or more wagers may be placed, and an amount of money to be wagered in the one or more types of wagers on the one or more competitors. For instance, if the pari-mutuel event is a horse race, a sample optimized wagering strategy for the horse race may comprise a wagering ticket produced, showing a date, track name, race number and the list of optimized wagers to be placed, such as the wagering ticket 1200.

Further, at 610, the method 600 may include transmitting, using the communication device, the optimized wagering strategy to the user device. Further, the user device may be configured for presenting the optimized wagering strategy.

Further, at 612, the method 600 may include transmitting, using the communication device, the optimized wagering strategy to an advance deposit wagering account associated with the user device.

In some embodiments, the method 600 may further include predicting, using a processing device, an order of finish among the plurality of top competitors of the pari-mutuel event. Further, the generating of the optimized wagering strategy may be based on the order of finish.

In some embodiments, the method 600 may further include receiving, using the communication device, a minimum return requirement from the user device. Further, the generating of the optimized wagering strategy may be based on the minimum return requirement.

In some embodiments, the method 600 may further include calculating, using the processing device, a success likelihood of each wager corresponding to each of the plurality of top competitors. Further, the calculating may be performed based on historical performance data of one or more of the user account and the at least one handicapper account.

In some embodiments, the method 600 may further include receiving, using the communication device, a minimum wager amount from a manager device operated by a manger of a betting pool associated with the pari-mutuel event. Further, the generating of the optimized wagering strategy may be based on the minimum wager amount.

In some embodiments, the method 600 may further include determining, using the processing device, a plurality of will-pay amounts corresponding to the plurality of top competitors. Further, a will-pay amount corresponding to a top competitor may represent an anticipated monetary amount returned from a winning wager placed on the top competitor. Further, the optimized wagering strategy may include the plurality of will-pay amounts. Accordingly, in some embodiments, a user may place multiple wagers associated with the top competitors and accordingly multiple payouts may be issued in case the multiple wagers turn out to be winning wagers.

The plurality of will pay amounts corresponding to the plurality of top competitors may be calculated for the plurality of types wagers including win bets, place bets, exacta bets, and trifecta bets.

Further, a precise series of steps may be taken to insure the accuracy of the projected will-pays. Initially, a process may be employed to adjust the total wagering amount wagered on win and place bets for an amount of tax or "take-out". Generally, the amount of "take-out" invoked may vary by taxing jurisdiction where the pari-mutuel event occurs and with the type of wager. Further, using a wagering amount left to be distributed, a process to determine how wagering amount may be available per dollar wagered for distribution to a winner. Further, the will-pay for win bets may be calculated. Further, will-pay for place bets may depend on an identity of the plurality of top competitors as in a place bet for second place, a two top competitors finishing first and second may both comprise winning place bets. Further, the method 600 may include estimating a likelihood of each top competitor finishing second or first, and determining a will-pay amount each place bet. Further, will-pay for exacta bets may be determined by retrieving will-pays for exactas from one or more external databases, and integrating the retrieved information with calculated win and place bets will-pays. Further, to determine will-pay for trifecta bets a proprietary methodology that may include a statistical likelihood that each top competitor of the plurality of top competitors may finish first, second or third, may be employed. Further, the method 600 may include determining, using the processing device, a likelihood of occurrence of each possible order of finish of the plurality of top competitors using statistical techniques. Further, a theoretical will-pay for trifecta bets may be determined which may presuppose that one or more trifecta bets may conform precisely to the statistically derived orders of finish. Further, the method 600 may include generating a significantly more accurate estimate of will-pays for trifecta bets by adjusting the one or more trifecta bets to the statistically derived orders of finish of the plurality of top competitors.

In some embodiments, the at least one will-pay amount may be further based on one or more of a tax, a fee and a commission imposed according to one or more of at least one type of wager corresponding to the at least one will-pay amount and a venue associated with the pari-mutuel event.

In some embodiments, the method may further include determining, using the processing device, for a two-entry wager corresponding to two top competitors of the plurality of top competitors, an indication of whether a first will-pay amount corresponding to the two-entry wager may be greater than a second will-pay amount corresponding to individual wagers associated with each of the two top competitors. Further, the optimized wagering strategy may include the indication.

According to some embodiments, a method of creating an optimized wagering strategy, consistent with the user's specified budget, for execution in a pari-mutuel environment is disclosed. The method may include identification, through a communication device, of an outside individual's ("handicapper's"), or the user's, top selections of the competitors among the plurality of the competitors.

Further, the method may include identifying, and eliminating top selection competitors who have withdrawn from the competition before the competition commences.

Further, the method may include receiving, using the communication device, wagering data from at least one wagering data source wherein the wagering data comprises money currently wagered on each competitor for each type of wager.

Further, the method may include determining from the wagering data the likely payout from a winning wager, for all wager types, considering all taxes, fees, commissions or other deductions, for all the chosen Top Selections;

Further, the method may include calculating, from the user's or Handicapper's historical record, the likelihood that each wager, on each top selection will be successful.

Further, the method may include determining, using the User's specified minimum required Return on Investment percentage, whether each wager on each selection can be expected to exceed the User's specified ROI minimum.

Further, the method may include determining, for each two-entry wager, (generally but not exclusively "Exacta" wagers) whether the wager promises a more favorable outcome than would be generated by individual wagers on each of the two entries.

Further, the method may include identifying, based on the foregoing, which possible wagers on which possible Top Selections represent a qualifying wagering investment.

Further, the method may include ranking and weighting each qualifying wager, insuring that the aggregate wager, if any, equals the User's Specified Budget and the individual wager amounts conform to the wagering venue's stated minimum, and creating therefrom a Wagering Strategy;

Further, the method may include calculating, for any order of finish, the expected return from the aggregate wager, if any.

Further, the method may include providing, for the User's information, the expected payout for a Trifecta wager on the Top Selections, in any order of finish;

Further, the method may include creating a graphic representation of a wagering ticket that implements the wagering strategy, and the ability to override the wagering strategy by making other wagers on other top selections.

Further, the method may provide a capability to electronically transmit the user's selected wagering strategy to an enterprise who accepts pari-mutuel wagers.

Figure 7:
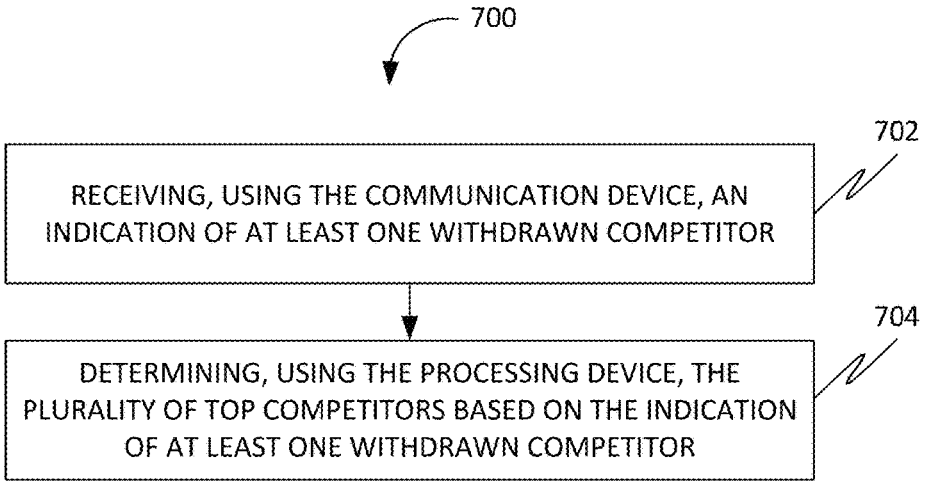
FIG. 7 shows a flowchart of a method to determine the plurality of top competitors, in accordance with some embodiments.

FIG. 7 shows a flowchart of a method 700 to determine the plurality of top competitors. Accordingly, at 702, the method 700 may include receiving, using the communication device, an indication of at least one withdrawn competitor.

Further, at 704, the method 700 may include determining, using the processing device, the plurality of top competitors based on the indication of at least one withdrawn competitor. Further, the determining of the plurality of top competitors may include removing the at least one withdrawn competitor from the plurality of top competitor, and adding at least one new top competitor. For instance, prediction data including a plurality of top competitors may be received from the handicapper device associated with the at least one handicapper account. For e.g., prediction data may include an indication related to a horse race in which a plurality of top competitors, namely "8", "4", and "6", in order. Further, one or more of the top competitors "8", "4", and "6", such as competitor "6" may withdraw from the race. Accordingly, wagering amount wagered related to competitor "6" may be withdrawn from the betting pool associated with the race. The method 700 may include determining the plurality of top competitors based on the indication of at least one withdrawn competitor, such as determining "8", "4", and an additional competitor namely "3" to be a top competitor.

Figure 8:
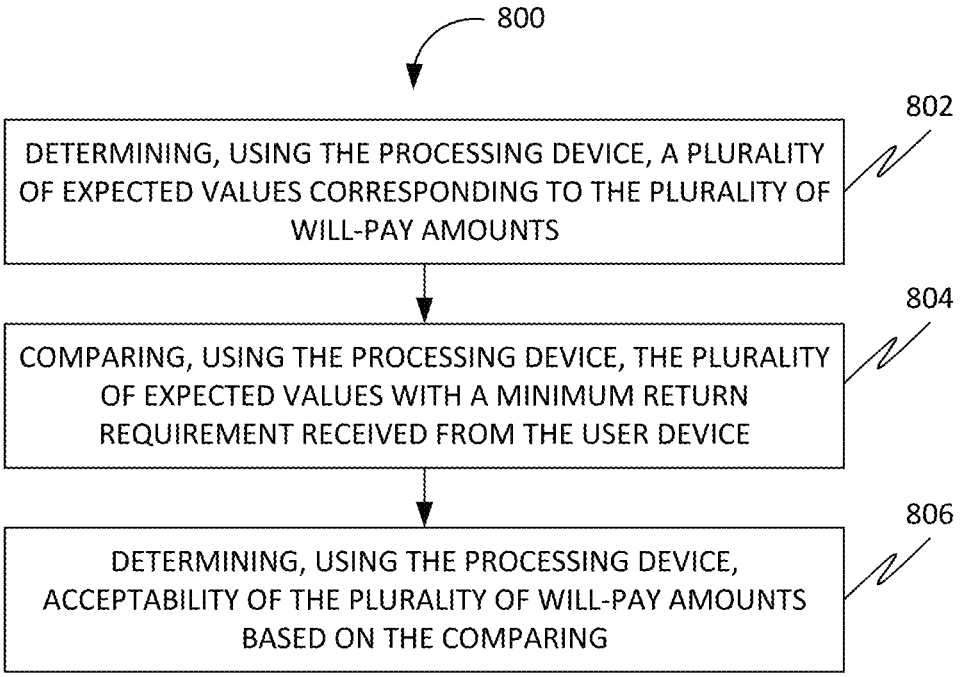
FIG. 8 shows a flowchart of a method of determining acceptability of will-pay amounts, in accordance with some embodiments.

FIG. 8 shows a flowchart of a method 800 of determining acceptability of will-pay amounts. Further, at 802, the method 800 may include determining, using the processing device, a plurality of expected values corresponding to the plurality of will-pay amounts. Further, the plurality of expected values may be based on historical performance data of one or more of the user account and the at least one handicapper account Further, at 804, the method 800 may include comparing, using the processing device, the plurality of expected values with a minimum return requirement received from the user device.

Further, at 806, the method 800 may include determining, using the processing device, acceptability of the plurality of will-pay amounts based on the comparing.

Further, the plurality of will-pay amounts for win and place bets may be determined to be acceptable based on expected value of the plurality of will-pay amounts alone. Further, an additional, more stringent test may be applied to determine the acceptability of the plurality of will-pay amounts for exacta bets. Specifically, the method 800 may include determining whether or not a given exacta pair has a promised will-pay higher or lower than a straight statistical computation may suggest. A lower will-pay, referred to an "Underlay" may not be deemed acceptable even if the expected value is satisfactory. To be acceptable, the plurality of will-pay amounts for exacta bets may be compared to a satisfactory expected value and a higher value of the plurality of will-pay amounts than simple statistical projection may (defined as an "Overlay"). Further, beyond simply exceeding the statistical projection, the method 800 may include building a minimum percentage amount by which the plurality of will-pay amounts for exacta bets may need to must exceed the statistical projection, thus avoiding the potential of misclassifying an "Overlay".

Figure 9:
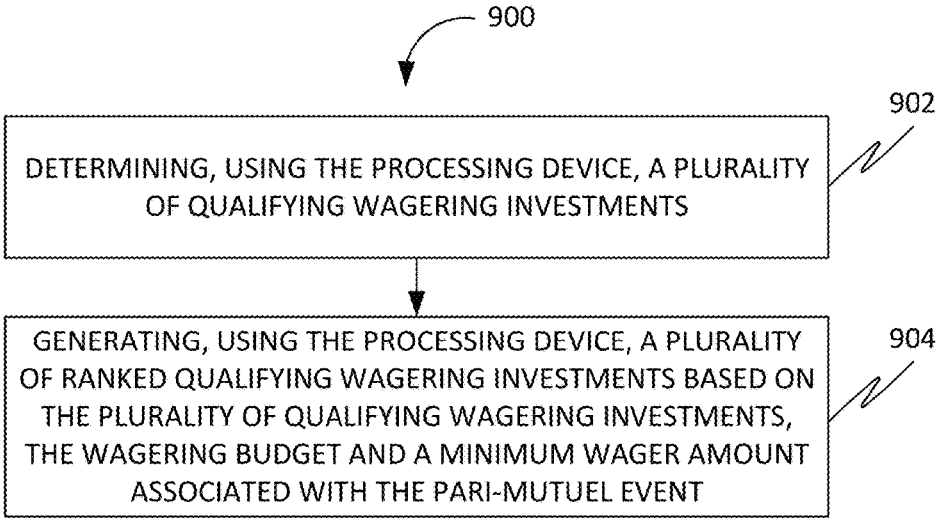
FIG. 9 shows a flowchart of a method of generating ranked qualifying wagering investments, in accordance with some embodiments.

FIG. 9 shows a flowchart of a method 900 of generating ranked qualifying wagering investments. Further, at 902, the method 900 may include determining, using the processing device, a plurality of qualifying wagering investments. Further, a qualifying wagering investment may correspond to a plurality of potential top competitors of the plurality of competitors.

Further, at 904, the method 900 may include generating, using the processing device, a plurality of ranked qualifying wagering investments based on the plurality of qualifying wagering investments, the wagering budget and a minimum wager amount associated with the pari-mutuel event. Further, the optimized wagering strategy may be based on the plurality of ranked qualifying wagering investments.

Figure 10:
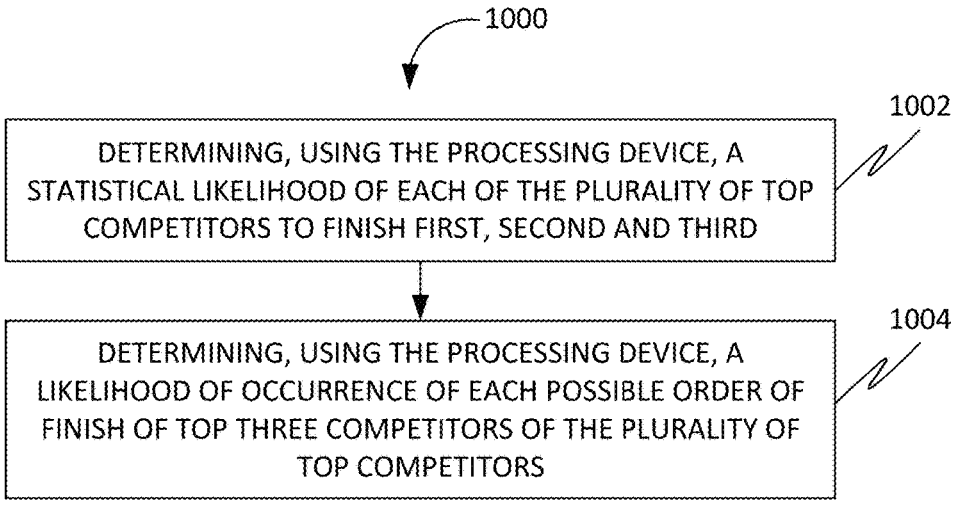
FIG. 10 shows a flowchart of a method 1000 of determining a likelihood of occurrence of each possible order of finish of top three competitors of the plurality of top competitors, in accordance with some embodiments.

FIG. 10 shows a flowchart of a method 1000 of determining a likelihood of occurrence of each possible order of finish of top three competitors of the plurality of top competitors. Further, at 1002, the method 1000 may include determining a will-pay amount corresponding to a trifecta bet comprises determining, using the processing device, a statistical likelihood of each of the plurality of top competitors to finish first, second and third.

Further, at 1004, the method 1000 may include determining, using the processing device, a likelihood of occurrence of each possible order of finish of top three competitors of the plurality of top competitors. Further, a will-pay amount corresponding to the trifecta bet may be determined based on the likelihood of occurrence.

Figure 13:
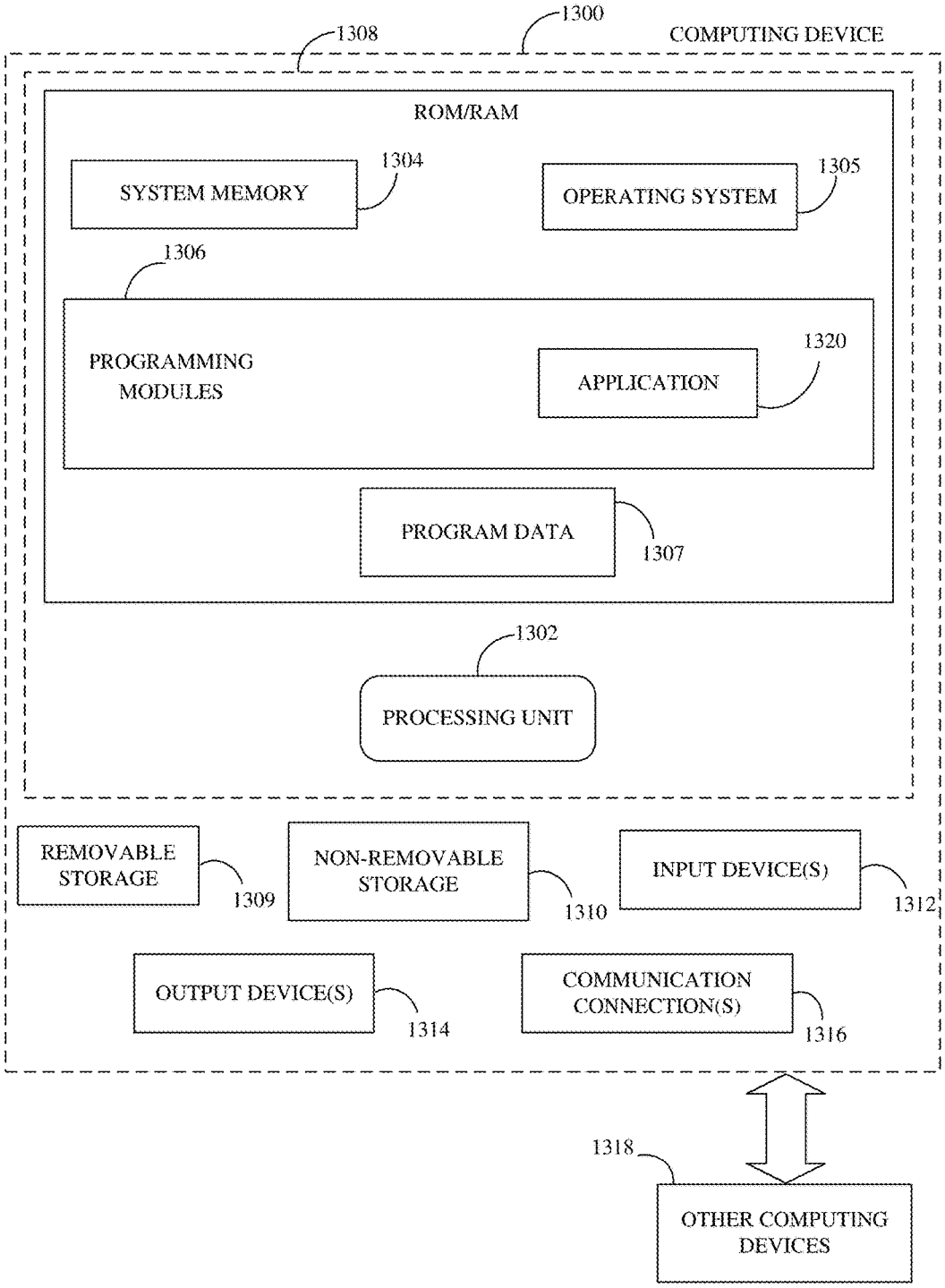
FIG. 13 is a block diagram of a computing device for implementing the methods disclosed herein, in accordance with some embodiments.

With reference to FIG. 13, a system consistent with an embodiment of the disclosure may include a computing device or cloud service, such as computing device 1300. In a basic configuration, computing device 1300 may include at least one processing unit 1302 and a system memory 1304. Depending on the configuration and type of computing device, system memory 1304 may comprise, but is not limited to, volatile (e.g. random-access memory (RAM)), non-volatile (e.g. read-only memory (ROM)), flash memory, or any combination. System memory 1304 may include operating system 1305, one or more programming modules 1306, and may include a program data 1307. Operating system 1305, for example, may be suitable for controlling computing device 1300's operation. In one embodiment, programming modules 1306 may include an image encoding module, machine learning module and/or image classifying module. Furthermore, embodiments of the disclosure may be practiced in conjunction with a graphics library, other operating systems, or any other application program and is not limited to any particular application or system. This basic configuration is illustrated in FIG. 13 by those components within a dashed line 1308.

Computing device 1300 may have additional features or functionality. For example, computing device 1300 may also include additional data storage devices (removable and/or non-removable) such as, for example, magnetic disks, optical disks, or tape. Such additional storage is illustrated in FIG. 13 by a removable storage 1309 and a non-removable storage 1310. Computer storage media may include volatile and nonvolatile, removable and non-removable media implemented in any method or technology for storage of information, such as computer-readable instructions, data structures, program modules, or other data. System memory 1304, removable storage 1309, and non-removable storage 1310 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1300. Any such computer storage media may be part of device 1300. Computing device 1300 may also have input device(s) 1312 such as a keyboard, a mouse, a pen, a sound input device, a touch input device, a location sensor, a camera, a biometric sensor, etc. Output device(s) 1314 such as a display, speakers, a printer, etc. may also be included. The aforementioned devices are examples and others may be used.

Computing device 1300 may also contain a communication connection 1316 that may allow device 1300 to communicate with other computing devices 1318, such as over a network in a distributed computing environment, for example, an intranet or the Internet. Communication connection 1316 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 1304, including operating system 1305. While executing on processing unit 1302, programming modules 1306 (e.g., application 1320 such as a media player) may perform processes including, for example, one or more stages of methods, algorithms, systems, applications, servers, databases as described above. The aforementioned process is an example, and processing unit 1302 may perform other processes. Other programming modules that may be used in accordance with embodiments of the present disclosure may include sound encoding/decoding applications, machine learning application, acoustic classifiers etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

What is claimed is:

1. A method of generating a graphic representation of a wagering ticket that implements an optimized wagering strategy, the method comprising:

receiving, using a communication device, a wagering budget, as established by a user, associated with a pari-mutuel event, wherein a limit is placed on an amount to be wagered by the user on the pari-mutuel event;

receiving, using the communication device, wagering data from at least one wagering data source, wherein the wagering data comprises money wagered on a competitor for each type of wager;

receiving, using the communication device, prediction data representing a predicted order of finish data from at least one handicapper, wherein the prediction data comprises a plurality of top competitors, or using the user's own predictions in the absence of a handicapper's predictions, whereby the top three selections in the pari-mutuel event are identified and considered for potential wagers, regardless of a chosen source;

determining, using a processing device, will-pay amounts corresponding to top three selections, wherein each will-pay amount represents an anticipated monetary amount returned from any winning wager placed on the top three selections;

retrieving, using the processing device, probability of likelihood of success for a winning wager for each possible wager, for each of the top three selections, as determined by either a historical record of the handicapper or the user, whichever source has been chosen for the top three selections;

generating, using the processing device, an optimized wagering strategy based on each of the wagering budget, the wagering data, the will-pay amounts, the predicted order of finish data, the probability of likelihood of success and a graphic representation of a wagering ticket that implements the optimized wagering strategy comprised of a set of wagers, wherein each wager of the set of wagers corresponds to a type of wager, a wagering amount and one or more of the top three selections;

transmitting, using the communication device, the graphic representation of the wagering ticket that implements the optimized wagering strategy to a user device, wherein the user device is configured for presenting the graphic representation of the wagering ticket that implements the optimized wagering strategy; and transmitting, using the communication device, the graphic representation of the wagering ticket that implements the optimized wagering strategy to an advance deposit wagering account associated with the user device.

2. The method of claim 1 further comprising:

receiving, using the communication device, an indication of any withdrawn competitor;

determining, using the processing device, the money wagered, the will-pay amounts and the predicted order of finish data of the plurality of top competitors based on the indication of at least one withdrawn competitor; and creating, using the processing device, a revised wagering strategy and a revised wagering ticket.

3. The method of claim 1 further comprising receiving, using the communication device, a minimum return requirement from the user device, wherein the generating of the graphic representation of the wagering ticket that implements the optimized wagering strategy is further based on the minimum return requirement.

4. The method of claim 1 further comprising receiving, using the communication device, a minimum wager amount from a manager device operated by a manager of a betting pool associated with the pari-mutuel event, wherein the generating of the graphic representation of the wagering ticket that implements the optimized wagering strategy is further based on the minimum wager amount.

5. The method of claim 1, wherein each will-pay amount is further based on at least one of a tax, a fee and/or a commission imposed according to the type of wager corresponding to the will-pay amount and a venue associated with the pari-mutuel event.

6. The method of claim 1 further comprising determining, using the processing device, for a two-entry wager corresponding to any two of top three competitors of the plurality of top competitors, an indication of whether the will-pay amount corresponding to the two-entry wager is greater than an amount of a will-pay amount as determined by a mathematical computation of the will-pay which would accrue in a strict mathematical sense, and whether the will-pay amount exceeds a minimum percentage, received from the user device, wherein the generating of the optimized wagering strategy and the graphic representation of the wagering ticket that implements the optimized wagering strategy are further based on the minimum percentage.

7. The method of claim 1 further comprising:

determining, using the processing device, all qualifying wagers, wherein a qualifying wagering corresponds to one or more of the top three selections, one or more types of wagers, satisfaction of a minimum return on investment, compliance with a minimum required wager, substantiation that any two selection wager exceeds a minimum specified excess percentage, considering likelihood of success; and generating, using the processing device, a ranking and weighting of qualifying wagering investments based on the wagering budget, thus creating a wagering strategy, wherein the graphic representation of the wagering ticket that implements the optimized wagering strategy is based on the ranked qualifying wagering investments.

8. The method of claim 1, wherein, determining a will-pay amount corresponding to a trifecta bet comprises:

determining, using the processing device, a statistical likelihood of each of the plurality of top competitors to finish first, second and third; and determining, using the processing device, a likelihood of occurrence of each possible order of finish of top three competitors of the plurality of top competitors, wherein a will-pay amount corresponding to the trifecta bet is determined based on the likelihood of occurrence, the ordinal ranking of the plurality of top competitors and the will-pay amounts for underlying two entry wagers contained within the top three competitors.

9. A system for generating a graphic representation of a wagering ticket that implements an optimized wagering strategy, the system comprising:

a communication device;

a processing device;

the system being configured for:

receiving, using the communication device, a wagering budget, as established by a user, associated with a pari-mutuel event, wherein a limit is placed on an amount to be wagered by the user on the pari-mutuel event;

receiving, using the communication device, wagering data from at least one wagering data source, wherein the wagering data comprises money wagered on a competitor for each type of wager;

receiving, using the communication device, prediction data representing a predicted order of finish data from at least one handicapper, wherein the prediction data comprises a plurality of top competitors, or using the user's own predictions in the absence of a handicapper's predictions, whereby the top three selections in the pari-mutuel event are identified and considered for potential wagers, regardless of a chosen source;

determining, using the processing device, will-pay amounts corresponding to top three selections, wherein each will-pay amount represents an anticipated monetary amount returned from any winning wager placed on the top three selections;

retrieving, using the processing device, probability of likelihood of success for a winning wager for each possible wager, for each of the top three selections, as determined by either a historical record of the handicapper or the user, whichever source has been chosen for the top three selections;

generating, using the processing device, an optimized wagering strategy based on each of the wagering budget, the wagering data, the will-pay amounts, the predicted order of finish data, the probability of likelihood of success and a graphic representation of a wagering ticket that implements the optimized wagering strategy comprised of a set of wagers, wherein each wager of the set of wagers corresponds to a type of wager, a wagering amount and one or more of the top three selections;

transmitting, using the communication device, the graphic representation of the wagering ticket that implements the optimized wagering strategy to a user device, wherein the user device is configured for presenting the graphic representation of the wagering ticket that implements the optimized wagering strategy; and transmitting, using the communication device, the graphic representation of the wagering ticket that implements the optimized wagering strategy to an advance deposit wagering account associated with the user device.

10. The system of claim 9 comprising:

the system being further configured for:

receiving, using the communication device, an indication of any withdrawn competitor;

determining, using the processing device, the money wagered, the will-pay amounts and the predicted order of finish data of the plurality of top competitors based on the indication of at least one withdrawn competitor; and creating, using the processing device, a revised wagering strategy and a revised wagering ticket.

11. The system of claim 9, wherein the communication device is further configured for receiving a minimum return requirement from the user device, wherein the generating of the graphic representation of the wagering ticket that implements the optimized wagering strategy is further based on the minimum return requirement.

12. The system of claim 9, wherein the processing device is further configured for calculating a success likelihood of each wager corresponding to each of the plurality of top competitors, wherein the calculating is performed based on historical performance data of at least one of the user account and the at least one handicapper account.

13. The system of claim 9 comprising:

the system being further configured for:

determining, using the processing device, for a two-entry wager corresponding to any two of top three competitors of the plurality of top competitors, an indication of whether the will-pay amount corresponding to the two-entry wager is greater than an amount of a will-pay amount as determined by a mathematical computation of the will-pay which would accrue in a strict mathematical sense, and whether the will-pay amount exceeds a minimum percentage, received from the user device, wherein the generating of the optimized wagering strategy and the graphic representation of the wagering ticket that implements the optimized wagering strategy are further based on the minimum percentage.

14. The system of claim 9 comprising:

the system being further configured for:

determining, using the processing device, all qualifying wagers, wherein a qualifying wagering corresponds to one or more of the top three selections, one or more types of wagers, satisfaction of a minimum return on investment, compliance with a minimum required wager, substantiation that any two selection wager exceeds a minimum specified excess percentage, considering likelihood of success; and generating, using the processing device, a ranking and weighting of qualifying wagering investments based on the wagering budget, thus creating a wagering strategy, wherein the graphic representation of the wagering ticket that implements the optimized wagering strategy is based on the ranked qualifying wagering investments.

* * * * *